US006921320B1

(12) United States Patent
Nielson et al.

(10) Patent No.: US 6,921,320 B1
(45) Date of Patent: Jul. 26, 2005

(54) SYSTEM AND METHODS FOR REDUCING DUST EMISSIONS

(76) Inventors: Chad J. Nielson, 444 E. 2270 N., Provo, UT (US) 84601; Lawrence G. Nielson, 1634 N. 1450 W., Provo, UT (US) 84604

( * ) Notice: Subject to any disclaimer, the term of this patent is extended or adjusted under 35 U.S.C. 154(b) by 106 days.

(21) Appl. No.: 10/325,258

(22) Filed: Dec. 19, 2002

(51) Int. Cl.[7] ..... B24B 1/00; B24B 23/00
(52) U.S. Cl. ..... 451/59; 451/353; 451/359; 451/456
(58) Field of Search ..... 451/59, 344, 350, 451/351, 352, 353, 354, 355, 356, 357, 358, 451/359, 451, 455, 488

(56) References Cited

U.S. PATENT DOCUMENTS

| | | | | | |
|---|---|---|---|---|---|
| 3,468,076 | A | * | 9/1969 | Jones | 451/456 |
| 3,935,678 | A | * | 2/1976 | Marton | 451/359 |
| 3,987,589 | A | * | 10/1976 | Marton | 451/359 |
| 4,381,628 | A | | 5/1983 | Dicke | |
| 4,598,500 | A | | 7/1986 | Faraudo et al. | |
| 4,622,782 | A | * | 11/1986 | Roestenberg | 451/456 |
| 4,805,256 | A | * | 2/1989 | Mason et al. | 15/320 |
| 4,932,163 | A | | 6/1990 | Chilton et al. | |
| 5,088,151 | A | * | 2/1992 | Legatt | 15/385 |
| 5,105,585 | A | | 4/1992 | Hampl et al. | |
| 5,527,207 | A | * | 6/1996 | Azar et al. | 451/344 |
| 5,545,082 | A | | 8/1996 | Courson et al. | |
| 5,713,785 | A | * | 2/1998 | Nishio | 451/451 |
| 5,791,979 | A | * | 8/1998 | Duncan et al. | 451/456 |
| 5,951,388 | A | | 9/1999 | Parsons | |
| 5,974,626 | A | * | 11/1999 | Wood et al. | 15/385 |
| 6,027,399 | A | * | 2/2000 | Stewart | 451/353 |
| 2002/0193056 | A1 | * | 12/2002 | Nielsen et al. | 451/350 |

OTHER PUBLICATIONS

*Mantex Equipment and Accessories*, www.maintex.com, pp. 95-110.
*Floor Style Winter 2002 Catalog*, www.floorstyle.com, pp. 1-68.
*Finishing Hardwood Flooring*, Nofma: The Wood Flooring Manufacturers Association, www.nofma.org/finishing.htm, 32 pages.
*Dust Control System for Propane Burnishers*, Parish Maintenance Supply, Syracuse, NY 13208, www.parish-supply.com/cimex_amigo.htm, pp. 1 and 2.
*Unique Wood Floors—Services*, Unique Wood Floors, www.uniquewodfloors.com/services.html, Mar. 13, 2003, pp. 1 and 2.
*Cleanroom Floor Machine*, Terra Universal, Inc., 700 N. Harbor Blvd. Anaheim, CA 92806, www.terrauniversal.com/products/cleanproducts/cirfirmachine.shtml, Mar. 13, 2003, pp. 1 and 2.
*H.E.P.A. Vacuums*, Ultrapure Technology, 325 Brogdon Road, Suwanee, Georgia 30024, www.ultrapuretechnology.com/hepavacuums.html, Mar. 13, 2003, pp. 1-3.

* cited by examiner

*Primary Examiner*—Timothy V. Eley
(74) *Attorney, Agent, or Firm*—Faegre & Benson LLP

(57) ABSTRACT

The systems for reducing dust emissions include a dust catch. In some cases, the dust catch includes an inlet and a discharger. The inlet can be arranged so that it surrounds an abrasive surface of an abrasion device, such as a sander. Dust generated by the abrasion surface can be captured in the inlet and discharged by the discharger. In various cases, the inlet is associated with a skirt including a dust screen. The methods can include attaching a dust catch to an abrasion device such that an inlet of the dust catch encompasses at least a portion of an outer perimeter of an abrasion surface associated with an abrasion device. The abrasion device can then be operated and at least a portion of dust generated by operating the abrasion device is captured by the dust catch.

19 Claims, 11 Drawing Sheets

SYSTEM AND METHODS FOR REDUCING DUST EMISSIONS

BACKGROUND OF THE INVENTION

This present invention provides systems and methods for reducing dust emissions. More particularly, the present invention relates to dust capture systems associated with abrasion devices, and methods of using such.

A number of activities generate dust particles that can be generally harmful to the health of an individual performing the activities, and detrimental to the general environment where the activities are performed. For example, after installing wood flooring, the flooring is sanded, finished, and buffed. The processes of sanding and buffing involve the use of sanders and/or buffers. The use of sanders and/or buffers results in the creation of and emission of dust particles. To avoid the health hazards associated with such dust particles, an individual operating the sander or buffer often wears some form of respirator or dust mask. While the use of respirators and/or dust masks reduces the amount of dust particles that are inhaled, some particles are still inhaled. Further, respirators can be both uncomfortable to wear and costly to obtain.

In addition, the use of respirators and dust masks do not eliminate or reduce the amount of dust particulates that are expelled into the general environment through the use of buffers and/or sanders. These dust particulates can coat windows and furniture creating a mess that is often difficult to clean up. To overcome this problem, plastic sheets have been hung over entrance ways to prevent such dust particulates from escaping into other rooms. Alternatively, some buffers and/or sanders have incorporated a system for gathering dust particulates through holes in an abrasive surface. This approach reduces the amount of dust particulates, but still allows a considerable quantity of particulates to escape into the surrounding environment. Thus, there exists a need in the art for advanced systems and methods for reducing dust emissions.

BRIEF SUMMARY OF THE INVENTION

Dust reduction systems and methods useful in relation to a variety of systems and devices. Some of the systems include a dust catch disposed around the periphery of an abrasion surface and/or an abrasion device. The dust catch can include an inlet and a discharger. In some cases, the discharger includes a vacuum that pulls dust particles in through the inlet and expels the particles into an accumulator. In various cases, the inlet is placed such that it surrounds at least a portion of an abrasion surface and/or abrasion device so that when dust particles are expelled from the abrasion surface or abrasion device, they are captured at the inlet, and removed to an accumulator by a discharger.

Some embodiments of the present invention provide methods for reducing dust emissions. Such methods can include providing an abrasion device that includes an abrasion surface with an outer perimeter. An abrasion device can be, but is not limited to, a hand sander, a hand buffer, a floor sander, a floor buffer, or the like. The abrasion element can be, but again is not limited to, a piece of sand paper, a buffing pad, a sanding wheel, or the like. The methods can further include attaching a dust catch to the abrasion device that includes an inlet. The inlet encompasses at least a portion of the outer perimeter of the abrasion element. Thus, for example, the inlet can surround the outer edged of a sanding or buffing wheel associated with a floor sander or floor buffer. As another example, the inlet can surround the outer edge of a piece of sand paper attached to a hand sander. In some cases, the inlet surrounds only a portion of the perimeter, while in other cases, the inlet surrounds the entire perimeter. In addition, the dust catch can include a discharger. This discharger can be, for example, a vacuum that can move dust near the inlet away from the inlet. The abrasion device can be operated, and at least a portion of the dust generated by operating the abrasion device is captured by the dust catch. In some cases, capturing the dust includes moving the dust from central areas of the abrasion surface to the periphery. This can include generating a vacuum in the inlet that moves dust particles near the inlet away from the inlet.

Some embodiments of the present invention provide methods for reducing dust emissions. Such methods can include providing an abrasion device that includes an abrasion surface with an outer perimeter. An abrasion device can be, but is not limited to, a hand sander, a hand buffer, a floor sander, a floor buffer, or the like. The abrasion surface can be, but is not limited to, a piece of sand paper, a buffing pad, a sanding wheel, or the like. The abrasion surface can move in relation to the abrasion device. Such movement can be, for example, rotational, vibrational, linear, or any combination thereof. The methods can further include attaching a dust catch to the abrasion device that includes an inlet. The inlet encompasses at least a portion of the outer perimeter of the abrasion element. Thus, for example, the inlet can surround the outer edged of a sanding or buffing wheel associated with a floor sander or floor buffer. As another example, the inlet can surround the outer edge of a piece of sand paper attached to a hand sander. In some cases, the inlet surrounds only a portion of the perimeter, while in other cases, the inlet surrounds the entire perimeter. The dust catcher further includes a discharger. In some cases, the discharger is a vacuum that moves dust particles from the inlet to, for example, an accumulator. The abrasion device can be operated, and at least a portion of the dust generated by operating the abrasion device is captured by the dust catch.

In some aspects of the present invention, the dust catch further includes a clamp for attaching the dust catch to an abrasion device. In such cases, attaching the dust catch to the abrasion device can include attaching the clamp to the abrasion device. In particular cases, the clamp is a flexible clamp, and attaching the clamp to the abrasion device includes flexing the flexible clamp until it snaps onto a rim of the abrasion device. In other cases, the abrasion device includes a clamp, and attaching the dust catch to the abrasion device includes attaching the clamp to the dust catch. In yet other cases, attaching the dust catch to the abrasion device includes coupling the dust catch to the abrasion device using a connector. Such a connector can be, but is not limited to: a screw, a cotter pin, a Velcro attachment, a wire, and a rivet.

In various aspects, the dust catch further includes a size adjustment. In one particular embodiment, the dust catch is formed in a ring shape, and the size adjustment is an adjustable connector coupling both ends of the dust connector together to form a ring. In various cases, the method includes modifying the size adjustment to match the size of the abrasion device. In further cases, modifying the size adjustment can include modifying the size adjustment such that a wheel of the abrasion device does not interfere with the discharger.

Other embodiments of the present invention provide systems for capturing dust particulates. The systems can include an inlet formed to at least partially encompass an outer perimeter of an abrasion surface. In some cases, when installed on an abrasion device, the inlet forms a ring, either partial or complete, around the outer edge of the abrasion device. In other cases, the inlet encompasses a non-circular area, such as a square or rectangular area. The systems further include a latch associated with the inlet, and a discharger coupled to the inlet. Such systems can be integral to an abrasion device or removable and attachable to an abrasion device.

In some instances, the system further includes a skirt forming an outer wall of the inlet. The skirt can include a dust barrier. The dust barrier can inhibit dust particles from escaping the periphery of an abrasion device to which the system is installed. Further, the dust barrier can comprise a group of brushes extending below the skirt and formed of a material strong enough to maintain a dust barrier and soft enough to avoid damaging a sanded object. Thus, for example, in a floor sanding operation, the brushes may be in contact with a floor being sanded and be sufficiently stiff to inhibit most dust particles from escaping the periphery of an abrasion device, without scratching or otherwise damaging the floor being sanded. In particular instances, the skirt is formed to fit a rotational floor sander, and the latch is operable to couple the skirt to the rotational floor sander. In yet other cases, the skirt includes a size adjustment element. The size adjustment element can be modifiable to adjust the size of the skirt, thus making the skirt amenable for attachment to one or more abrasion devices.

Yet further embodiments of the present invention provide systems for capturing dust particulates. The systems can include an abrasion device that comprises an abrasive surface with an outer perimeter. The systems further include a dust catch associated with the abrasion device. The dust catch comprises an inlet formed to at least partially encompass the outer perimeter, a skirt associated with the inlet, and a discharger coupled to the inlet. In particular cases, the dust catch is integral with the abrasion device, while in other cases, the dust catch is removable and attachable with the abrasion device. The abrasion device can be, but is not limited to, a vibrational hand sander, a rotational floor sander; a rotational hand sander; a vibrational floor sander, or the like. In various cases, the dust catch further includes an accumulator coupled to the discharger.

This summary provides only a general outline of the embodiments according to the present invention. Many other objects, features and advantages of the present invention will become more fully apparent from the following detailed description, the appended claims and the accompanying drawings.

BRIEF DESCRIPTION OF THE DRAWINGS

A further understanding of the nature and advantages of the present invention may be realized by reference to the figures which are described in remaining portions of the specification. In the figures, like reference numerals are used throughout several figures to refer to similar components. In some instances, a sub-label consisting of a lower case letter is associated with a reference numeral to denote one of multiple similar components. When reference is made to a reference numeral without specification to an existing sub-label, it is intended to refer to all such multiple similar components.

DETAILED DESCRIPTION OF THE INVENTION

Dust reduction systems and methods useful in relation to a variety of systems and devices. Some of the systems include a dust catch disposed around the periphery of an abrasion surface and/or an abrasion device. The dust catch can include an inlet and a discharger. In some cases, the discharger includes a vacuum that pulls dust particles in through the inlet and expels the particles into an accumulator. In various cases, the inlet is placed such that it surrounds at least a portion of an abrasion surface and/or abrasion device so that when dust particles are expelled from the abrasion surface or abrasion device, they are captured at the inlet, and removed to an accumulator by a discharger. In some cases, the inlet surrounds less than a quarter of the perimeter of the abrasion surface, while in other cases, the inlet entirely surrounds the abrasion surface.

Figure 1A:
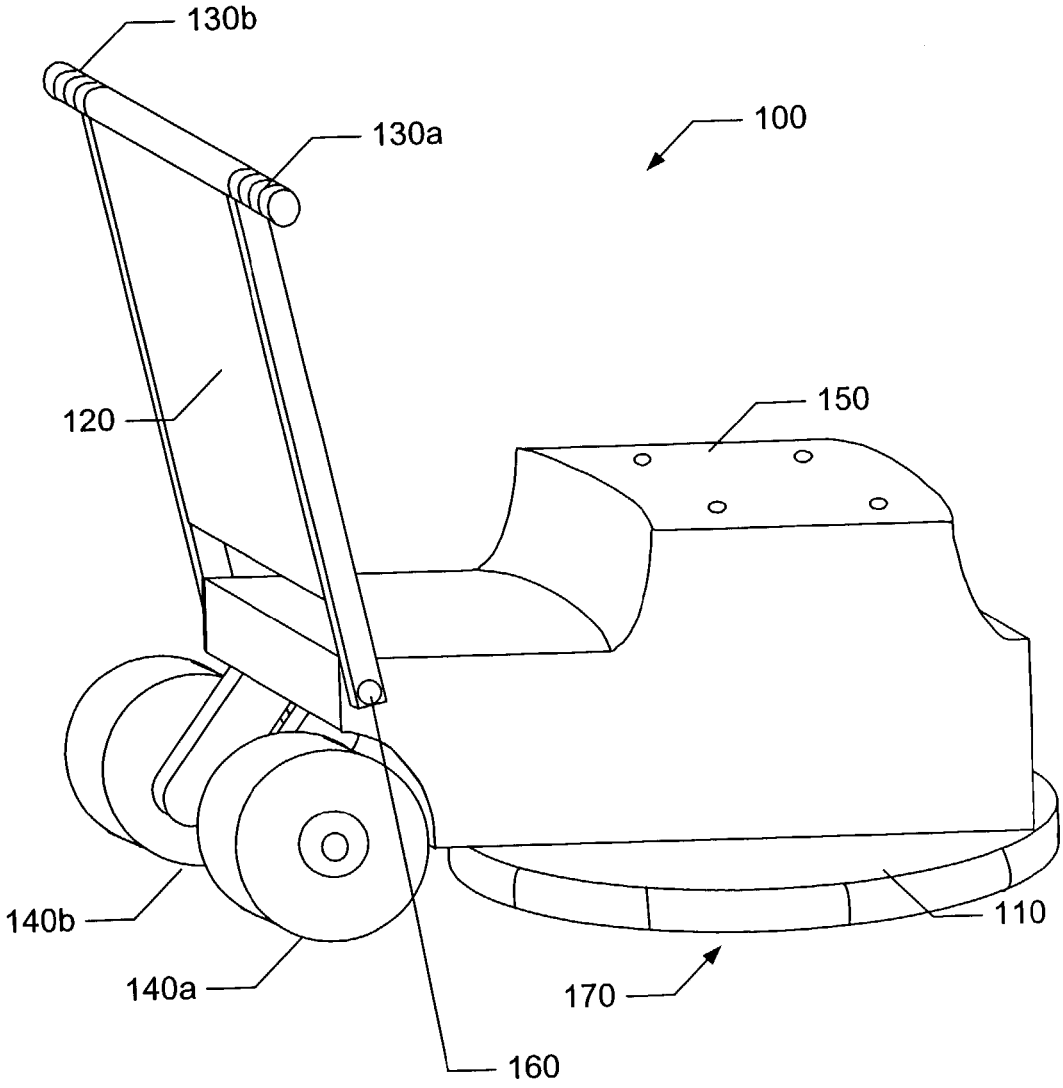
Figure 1A (Prior Art)
FIGS. 1*a* and 1*b* illustrate prospective views of a prior art floor buffer/sander.
Figure 1B:
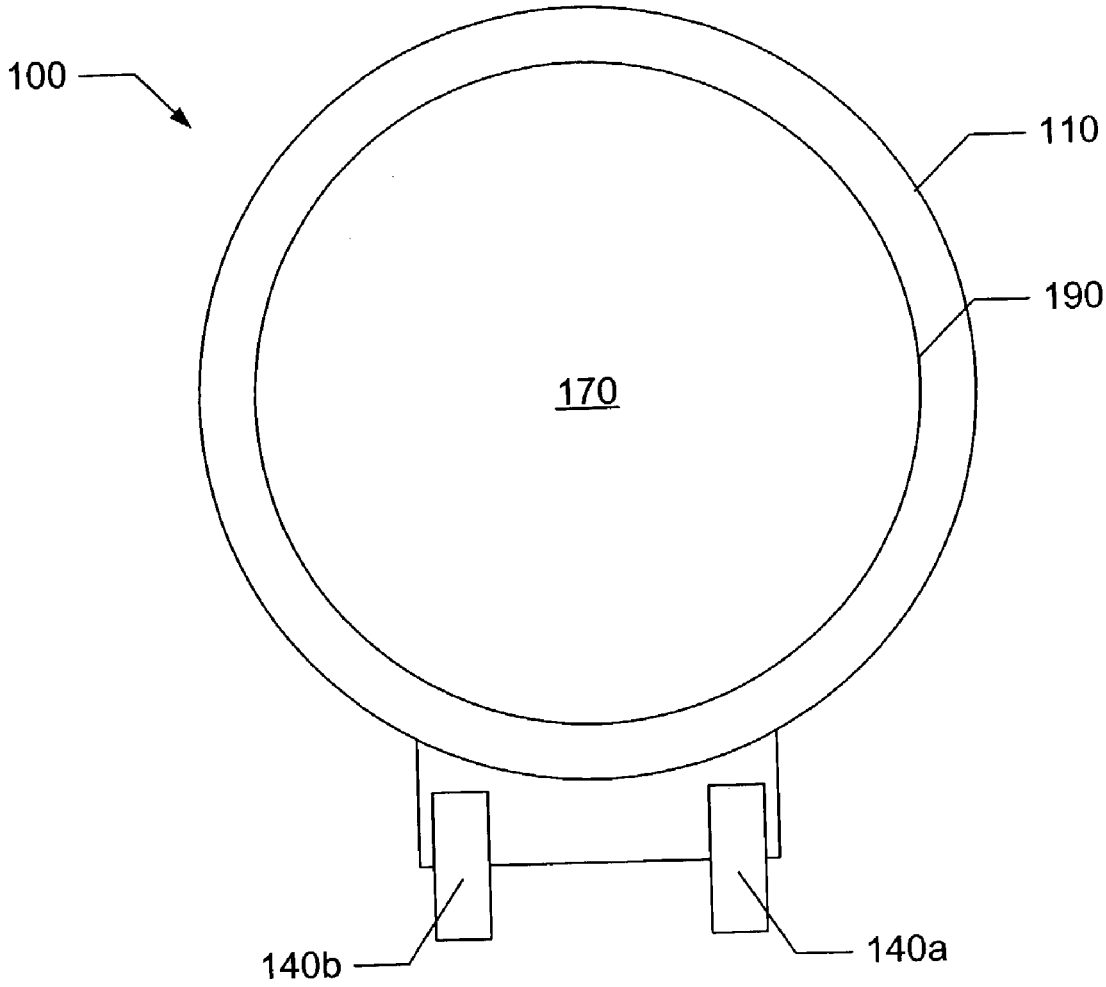
Figure 1B (Prior Art)

Turning to FIGS. 1*a* and 1*b*, a prior art floor sander 100 and/or buffer is illustrated. For the purposes of this document, only the sanding functionality is discussed, however, it should be recognized that similar principles can be used in relation to a buffer. Floor sander 100 includes a deck 110 under which an abrasion surface 170 is mounted (shown on the bottom view of FIG. 1*b*). As illustrated in FIG. 1*b*, abrasion surface 170 has an outer perimeter 190. Floor sander 100 further includes a motor case 150, wheel 140 a handle 120 attached by a pivot 160, and hand grips 130. Various dust catches in accordance with the present invention can be applied to floor sander 100. For example, a dust catch can be formed integral to floor sander 100, or a removable dust catch can be attached to floor sander 100.

Figure 2A:
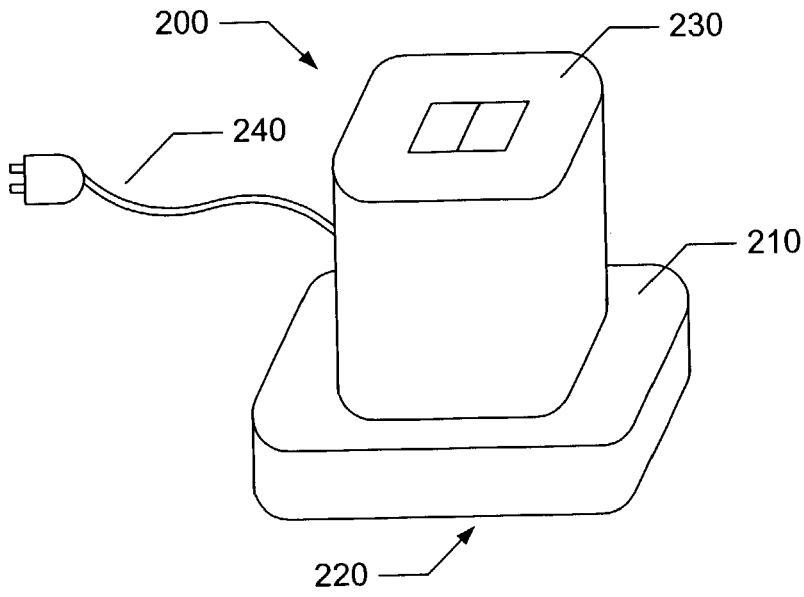
Figure 2A (Prior Art)
FIGS. 2*a* and 2*b* illustrate prospective views of a prior art hand buffer/sander.
Figure 2B:
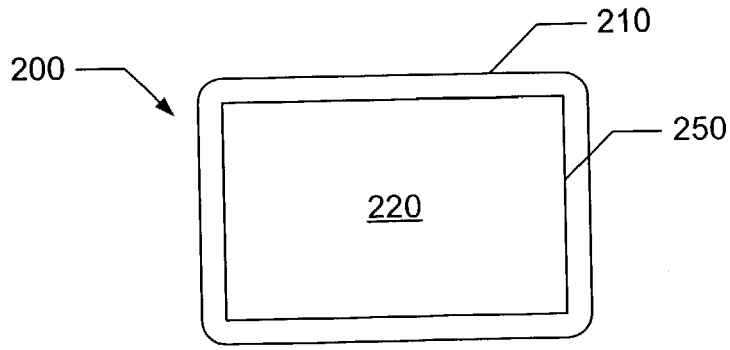
Figure 2B (Prior Art)

Turning to FIGS. 2*a* and 2*b*, a prior art hand sander 200 and/or buffer is illustrated. For the purposes of this document, only the sanding functionality is discussed, however, it should be recognized that similar principles can be used in relation to a buffer. Hand sander 200 includes a deck 210 under which an abrasion surface 220 is mounted (shown on the bottom view of FIG. 2*b*). As illustrated in FIG. 2*b*, abrasion surface 220 has an outer perimeter 250. Hand sander 200 can further include a motor case 230 and a power cord 240. Various dust catches in accordance with the present invention can be applied to hand sander 200. For example, a dust catch can be formed integral to hand sander 200, or a removable dust catch can be attached to hand sander 200.

FIGS. 3*a*–3*d* illustrate a dust catch 300 in accordance with some embodiments of the present invention. Referring to the top view of FIG. 3*a*, dust catch 300 includes a skirt 345. In some embodiments, the size of skirt 345 can be adjusted using a size adjustment 340. In some cases, size adjustment 340 is a variable clamp that can be adjusted using a screw 341. Based on the disclosure provided herein, one of ordinary skill in the art will recognize a variety of other size adjustments that can be used in accordance with the present invention.

Dust catch 300 further includes exhaust ports 330 and connectors 335 associated therewith. Exhaust channels 331 are formed in exhaust ports 330 and provide a pathway whereby dust can be exhausted from within the perimeter of skirt 345. Dust exhaust passes through exhaust channels 331, and through hoses 320 to a T-connector 310. T-connector 310 can be coupled to a discharger responsible for forcing dust from within the perimeter of skirt 345 and to an accumulator (not shown).

For the purposes of this document, a discharger can be any device and/or machine capable of forcing dust particulates generated within the perimeter of skirt 345 through one or both of exhaust ports 330. In one particular embodiment, the discharger is a vacuum attached to T-connector 310. In such an embodiment, air and dust particulates are drawn through exhaust ports 330 using a vacuum force. In other embodiments, T-connector 310 is not included, and the discharger includes a blower coupled to hose 320*a* that blows air into exhaust port 330*a*, and a vacuum coupled to hose 320*b* that pulls air and dust particulates from exhaust port 330*b*. In such an embodiment, dust particulates are driven toward exhaust port 330*b* both by vacuum force, and by blowing force. As will be described in further detail below, either or both of the vacuum force and/or blowing force can be confined within an inlet (not shown) formed in skirt 345.

Figure 3A:
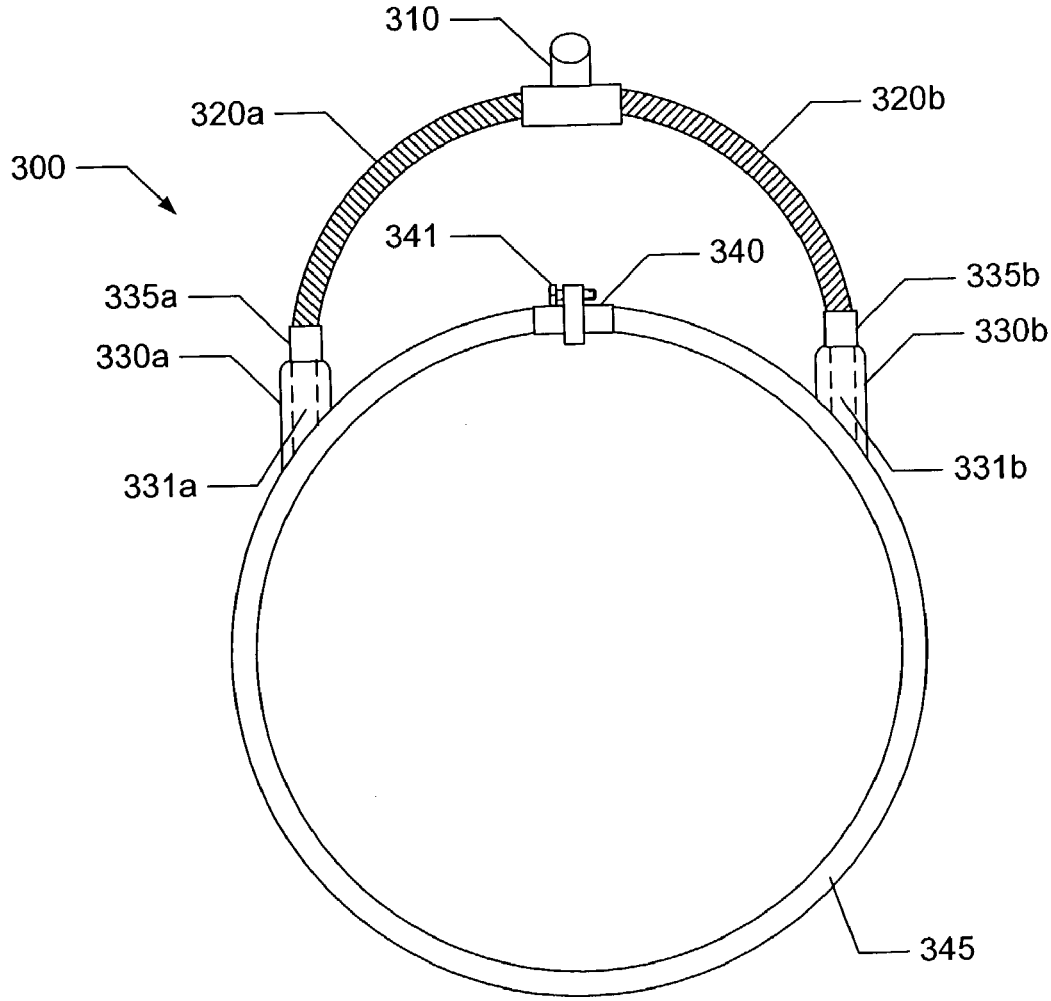
FIG. 3*a* illustrates a top view of a dust catch in accordance with various embodiments of the present invention.
Figure 3B:
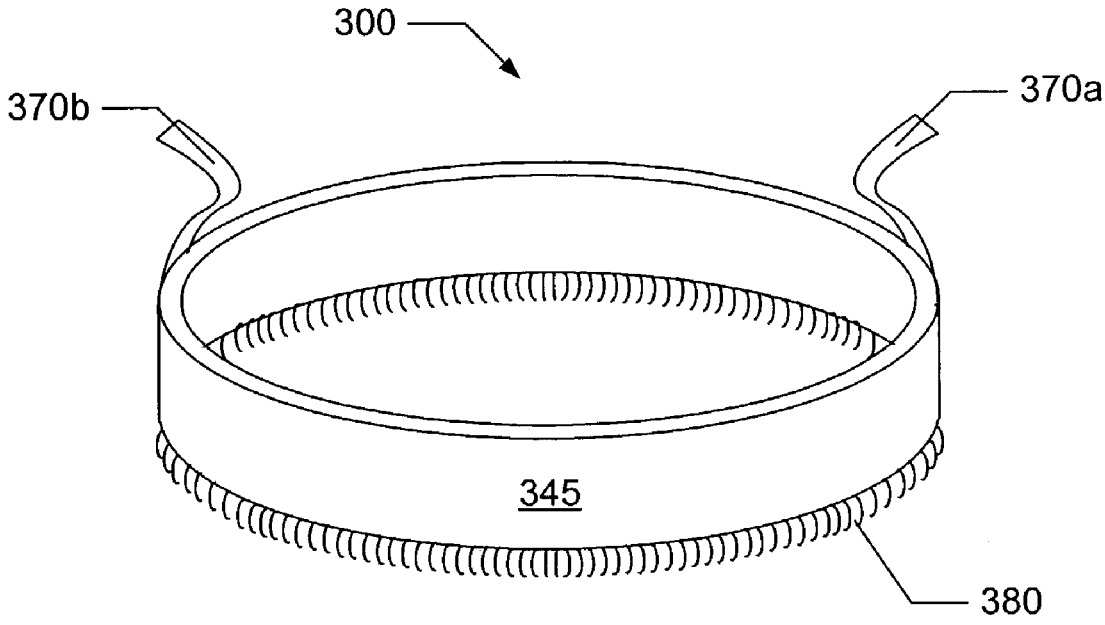
FIG. 3*b* illustrates a side view of a dust catch in accordance with various embodiments of the present invention.

Turning to FIG. 3*b*, a side view of dust catch 300 is illustrated. As illustrated, dust catch 300 includes one or more clamps 370 and a flexible barrier 380. Flexible clamps 370 can be used to attach dust catch 300 to the deck of an abrasion device, such as those illustrated in FIGS. 1 and 2. In some cases, flexible clamps 370 can be replaced with screws, cotter pins, a Velcro attachment, a wire, a rivet, or the like. As such, the screws can be used to attach dust catch 300 to an abrasion device. In yet other embodiments, dust catch 300 is integrated with an abrasion device and no such latches, screws, or cotter pins are included. Flexible barrier 380 provides a barrier between skirt 345 and a surface being sanded or buffed. Thus, in a floor sanding operation, flexible barrier 380 is in contact with the floor. Flexible skirt 380 serves various purposes as further described below.

Figure 3C:
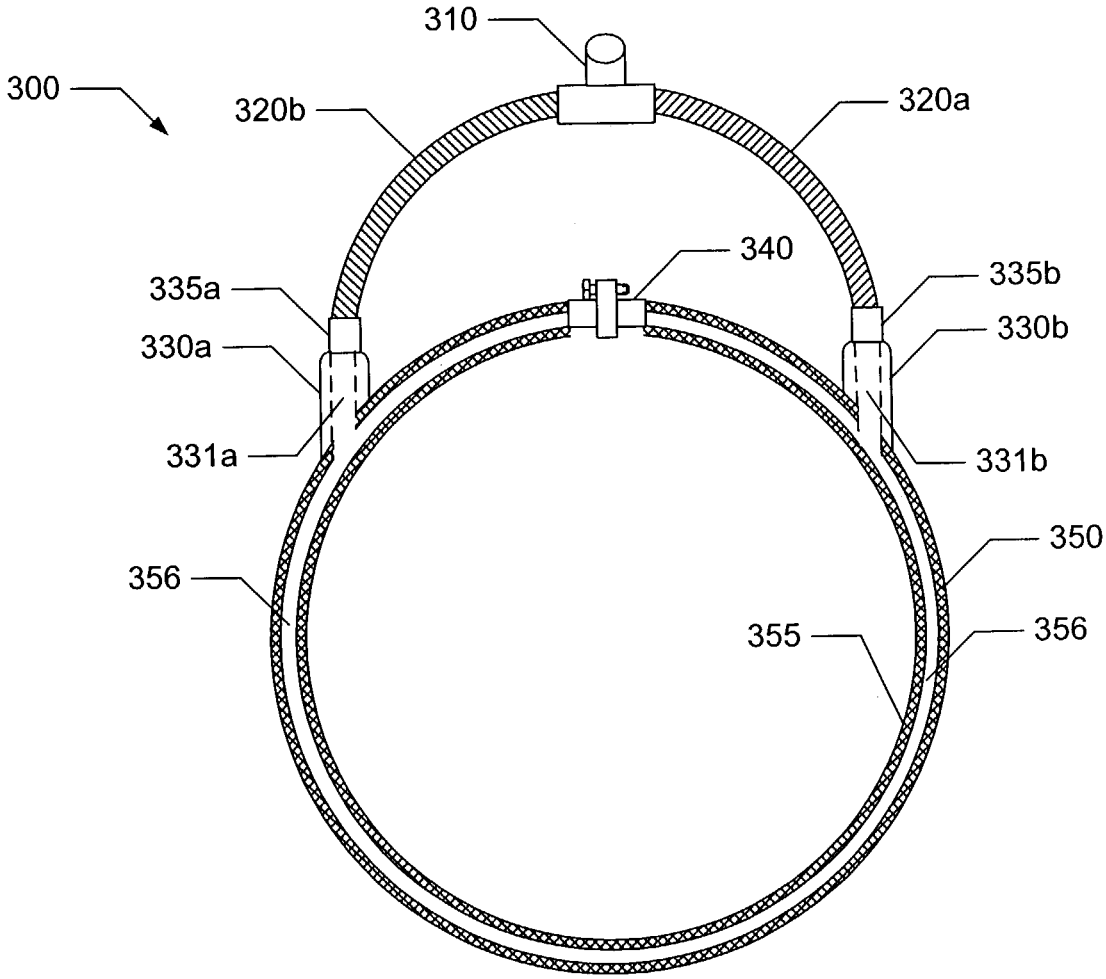
FIG. 3*c* illustrates a bottom view of a dust catch in accordance with various embodiments of the present invention.

Turning to FIG. 3*c*, a bottom view of dust catch 300 is illustrated. In addition to the elements previously described in relation to FIGS. 3*a* and 3*b*, an inlet 356 is formed between an inner wall 355 and an outer wall 350 of skirt 345. As further described in relation to FIG. 4 below, flexible barrier 380 can extend from either or both of inner wall 355 and/or outer wall 350. As illustrated in this embodiment, inlet 356 forms a channel that when dust catcher 300 is installed extends around a portion of the perimeter of an abrasion surface (not shown). Exhaust ports 330 are associated with outer wall 350, and exhaust channels 331 form openings through outer wall 350 allowing for the creation of a vacuum, or other force within inlet 356.

In some cases, dust particulates are moved from within the perimeter of inner wall 355 of skirt 345 to inlet 356. Movement of the dust particulates toward inlet 356 is caused by the motion of a moving abrasion surface (not shown) within the perimeter of skirt 345 and/or the movement of an associated abrasion device (not shown). The movement of abrasion surface can be rotational as in the case of a floor sander illustrated in FIG. 1. Alternatively, the movement can be vibrational incorporating either or both linear movement and rotational movement, or linear in the case of a hand sander with a ring of sand paper associated therewith. A vacuum or other force formed within inlet 356 by the discharger coupled to hoses 320 draws the dust particulates within inlet 356 toward one or the other of exhaust ports 330, and toward an accumulator (not shown) via hoses 320. In this way, a significant amount of dust particulates generated by operating an abrasion device can be captured in an accumulator before such dust particulate escape the outer wall 350 of skirt 345.

Based on the disclosure provided herein, one of ordinary skill in the art will recognize a number of different shapes in which dust catch 300 can be formed. For example, skirt 345 of dust catch 300 can be a square shape formed to fit the perimeter of sander 200 discussed above. Further, inlet 356 can be formed to encompass more or less of the perimeter of an abrasion surface. For example, inlet 356 can be formed where the most significant occurrence of dust particulates is found. This can be at key locations around the perimeter of the abrasion surface, or around the entire abrasion surface. Furthermore, the length and/or volume of inlet 356 can be modified to provide a desired amount of force from the discharger. Thus, for example, where a low power discharger is used, a lower volume of inlet 356 may be desirable to increase the amount of force per unit volume of inlet 356.

Figure 3D:
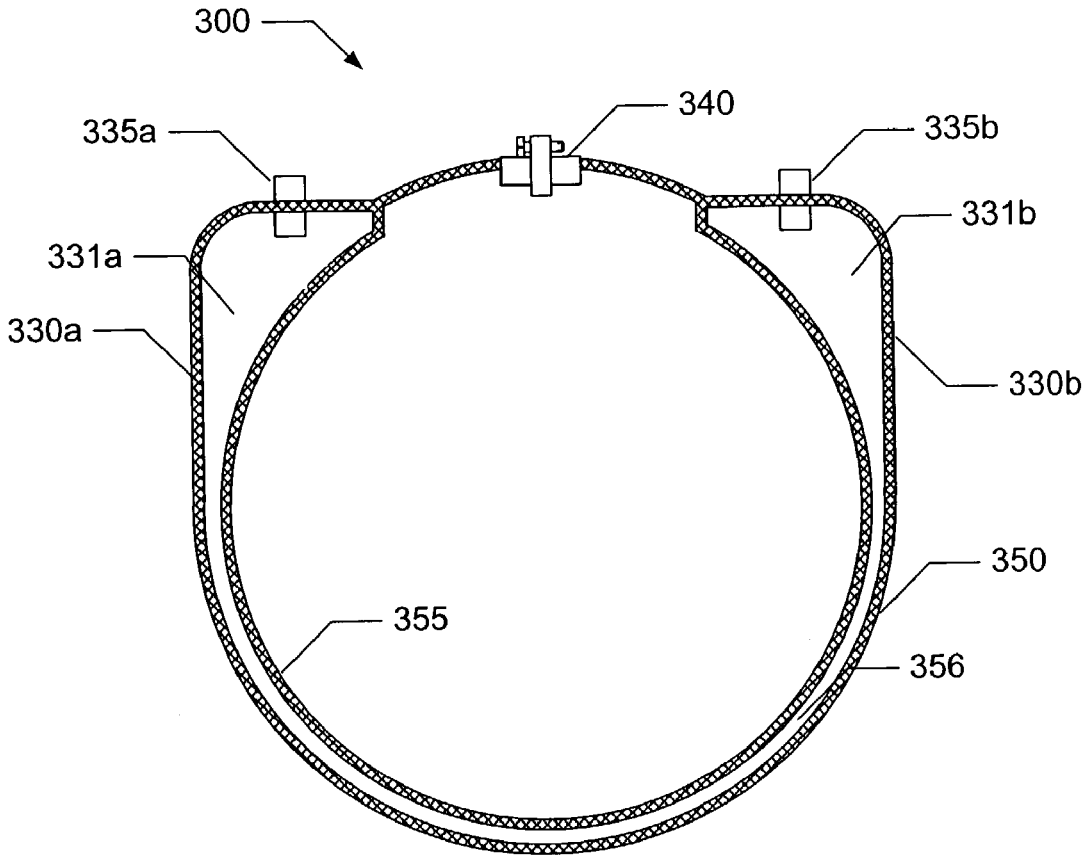
FIG. 3*d* illustrates a bottom view of another dust catch in accordance with other embodiments of the present invention.

Turning to FIG. 3*d*, a bottom view of an alternate embodiment of dust catch 300 is illustrated. As illustrated, outer wall 350 extends to form part of exhaust ports 330. Exhaust channels 331 are the open areas in exhaust ports 330. Connectors 335 extend through the wall of exhaust ports 330 (i.e., outer wall 350) and provide for connection to exhaust hoses 320 (not shown). In this embodiment, a discharger connected via connectors 335 create a force in exhaust channels 331 and inlet 356. This force draws dust particulates in channels 331 and inlet 356 out through one or both of connectors 335. Also, in this embodiment, inlet 356 extends primarily around the front perimeter of an abrasion surface, but not around the back perimeter.

Figure 4A:
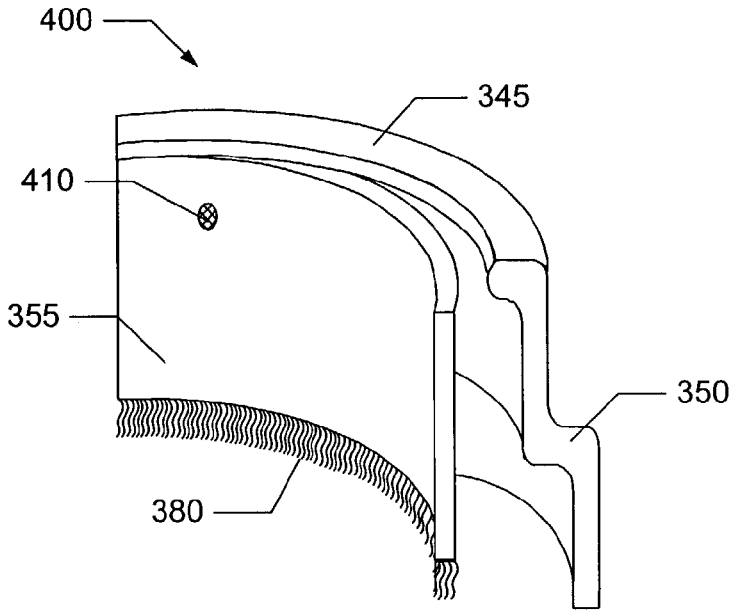
FIGS. 4*a* and 4*b* illustrate the inner and outer walls of one particular dust catch in accordance with embodiments of the present invention.
Figure 4B:
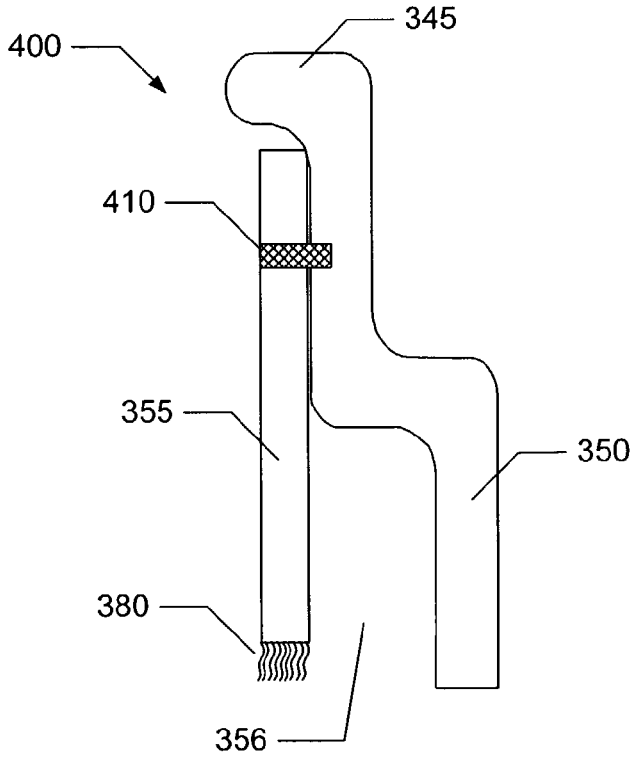

Referring now for FIGS. 4*a*, 4*b*, a portion 400 of skirt 345 is illustrated. As illustrated, skirt 345 includes inner wall 355 and outer wall 350 attached by a screw 410. In some cases, it is advantageous to form outer wall 350 using a flexible material, such as a soft plastic, so that it does not damage walls or other structure that it contacts during the operation of an associated abrasion device. In other embodiments, a more durable material, such as metal or a hard plastic is desirable. Inner wall 355 can be made of any material capable of forming an inlet 356 through coupling with outer wall 350. In one particular embodiment, a durable plastic is used to form inner wall 355.

In the illustrated embodiment, flexible barrier 380 is formed on the bottom of inner wall 355. Flexible barrier 380 is formed of a material sufficiently soft and/or flexible that a structure and/or material being operated on by an associated abrasion device will not be damaged by contact with flexible barrier 380. In addition, the material for flexible barrier 380 is chosen to be sufficiently rigid to maintain at least some of the integrity of inlet 356. In this way, the forces formed within inlet 356 are maintained within the inlet and diffusion of the forces by escaping under inner and outer walls 355, 350 is minimized. In some embodiments, flexible barrier 380 is formed on both inner wall 355 and outer wall 350. In one particular embodiment, flexible barrier 380 is formed by a series of brushes extending from one or the other of inner wall 355 and/or outer wall 350. In other embodiments, flexible barrier 380 is composed of a rubber, or foam material. While inner wall 355 and outer wall 350 are illustrated as separate elements attached with a screw, one of ordinary skill in the art will recognize that skirt 345 can be a single piece with inner wall 355 and outer wall 350 integrally formed into a single piece.

Figure 5A:
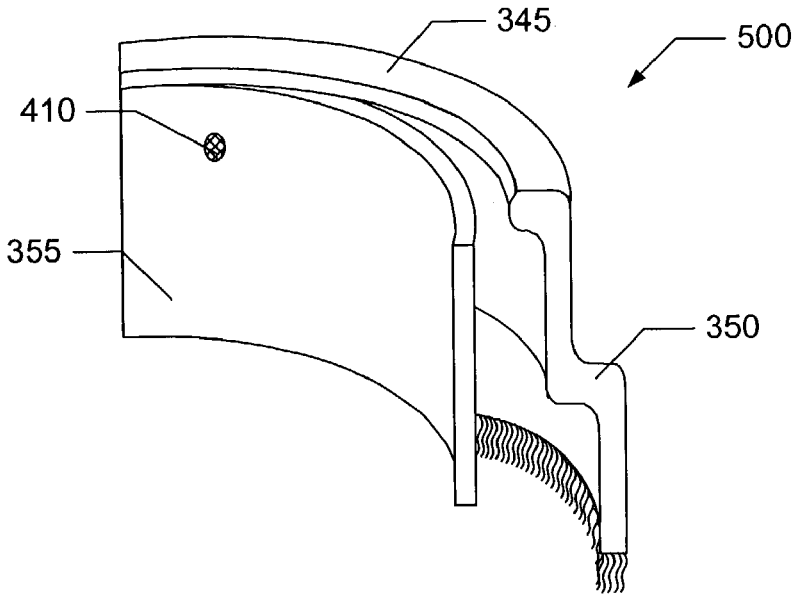
FIGS. 5*a* and 5*b* illustrate the inner and outer walls of another dust catch in accordance with embodiments of the present invention.
Figure 5B:
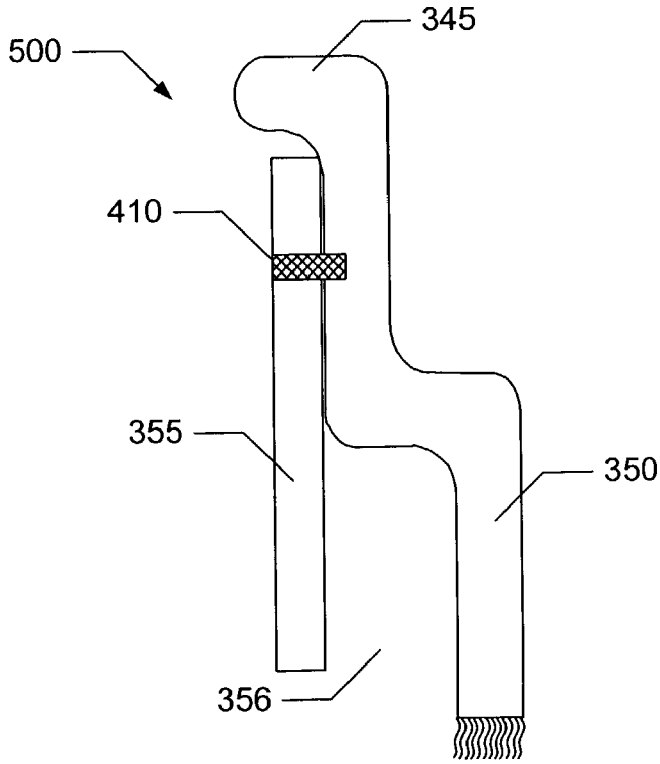

Referring to FIGS. 5*a*, 5*b*, an alternate portion 500 of skirt 345 is illustrated. As illustrated, flexible barrier 380 is associated with outer wall 350. This helps to maintain forces generated by the discharger within inlet 356, and further limits the escape of dust particles beyond outer wall 350.

Figure 6:
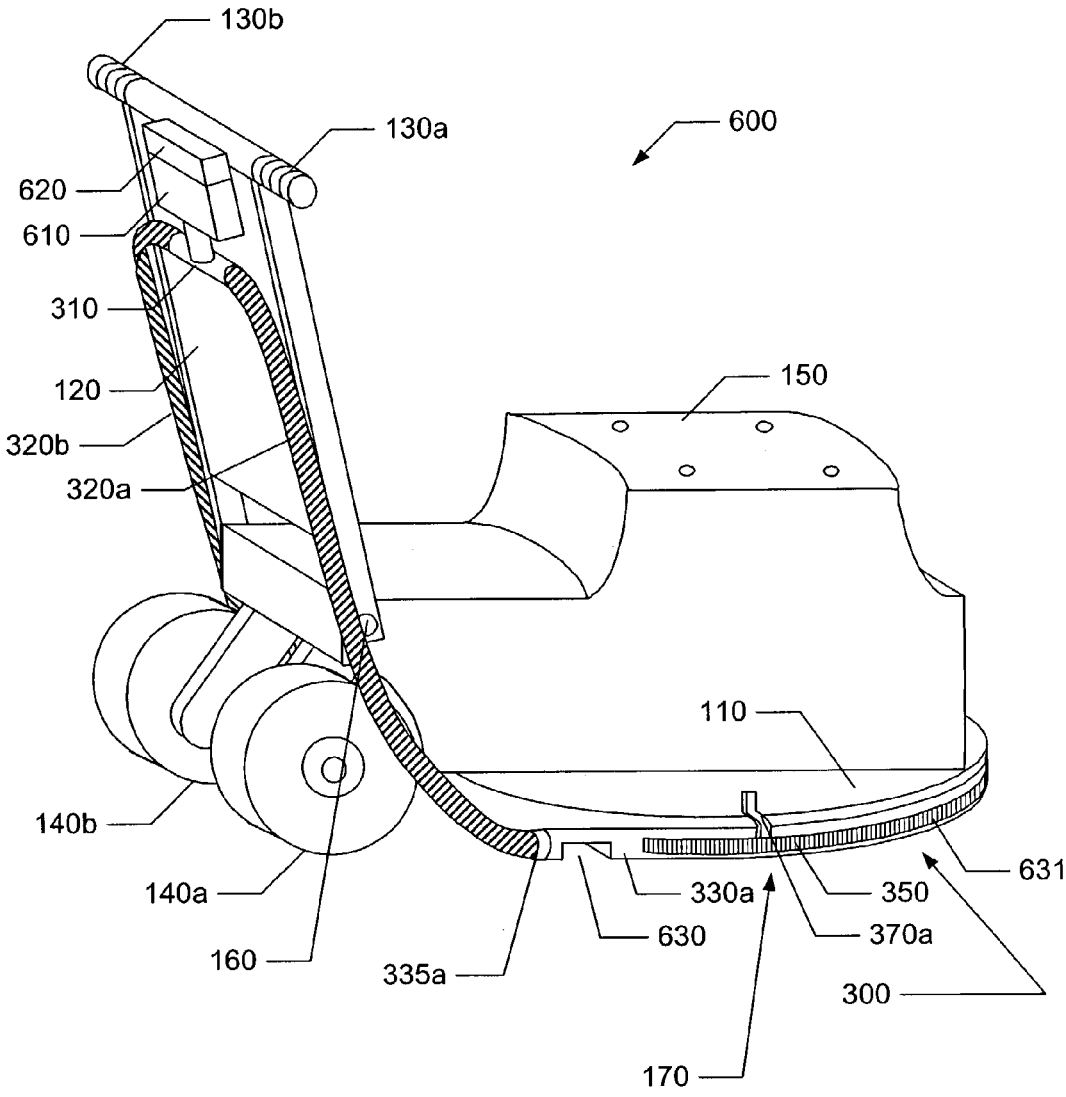
FIG. 6 illustrates a floor sander with a dust catch in accordance with an embodiment of the present invention.

Turning to FIG. 6, dust catch 300 is shown attached to an exemplary abrasion device 100. As illustrated, dust catch 300 is attached to deck 110 using latches 370. A discharger 610 and an accumulator 620 are attached to handle 126 and coupled to T-connection 310. In this case, discharger 610 is a vacuum and accumulator 620 is associated with vacuum 610. Vacuum 610 generates a force through hoses 320 and in inlet 356 (not shown). This force pulls dust particulates generated through the movement of abrasion surface 170 into accumulator 620. The positioning of exhaust ports 330 is chosen such that impediments, such as wheels 140, do not interfere.

Further, in some embodiments of the present invention, a soft bumper 631 is attached to the outer wall of skirt 345. In some cases, soft bumper 631 is a no-scuff rubber bumper that protects against damage to baseboards when floor sander 600 comes into contact with the baseboards. In addition, some embodiments of the present invention include a slot 630 in the outer wall of skirt 345. Such a slot allows for suction of shavings and/or other materials that may be present on a floor. Such shavings can be removed to accumulator 620.

Figure 7:
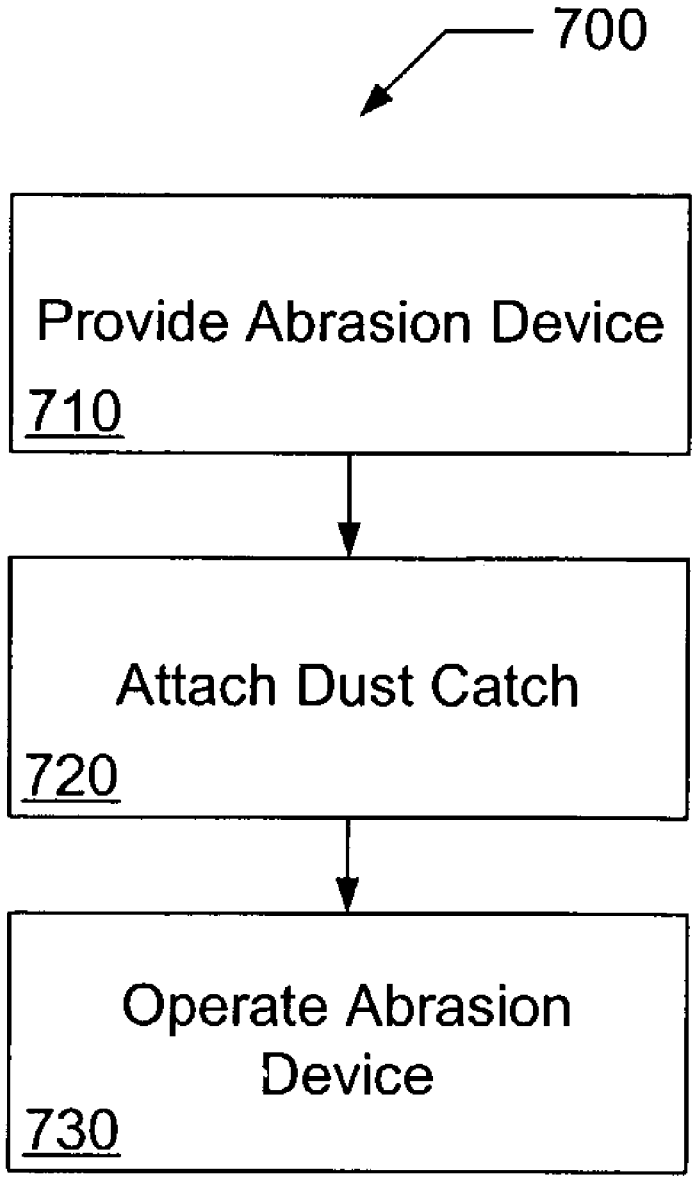
FIG. 7 is a flow diagram illustrating one method of utilizing a dust catch in accordance with embodiments of the present invention.

Referring now to FIG. 7, a flow diagram 700 illustrates one embodiment of a method for using a dust catch in accordance with the present invention. Following flow diagram 700, an abrasion device, such as a hand sander, a hand buffer, a floor buffer, a floor sander, or the like is provided (block 710). An appropriate dust catch is attached to the provided abrasion device (block 720). This can include, for example, attaching latches 370 to the deck of the abrasion device, or any other provided mechanism for attaching the dust catch to the abrasion device. The abrasion device can then be operated with the benefit of the dust catch (block 730). Using such an approach, existing abrasion devices can be retrofitted to include a dust catch in accordance with the present invention. Further, abrasion devices that do not always require a dust catch can be operated without a dust catch.

The invention has now been described in detail for purposes of clarity and understanding. However, it will be appreciated that certain changes and modifications may be practiced within the scope of the appended claims. For example, dust catches in accordance with the present invention can be either separate from an abrasion device, or integral to an abrasion device. Further, the functions of the systems and methods of using such are merely exemplary. Accordingly, it should be recognized that many other systems, functions, methods, and combinations thereof are possible in accordance with the present invention. Thus, although the invention is described with reference to specific embodiments and figures thereof, the embodiments and figures are merely illustrative, and not limiting of the invention. Rather, the scope of the invention is to be determined solely by the appended claims.

What is claimed is:

1. A method for reducing dust emissions, the method comprising:

providing an abrasion device, wherein the abrasion device includes an abrasion element with an outer perimeter;

attaching a dust catch to the abrasion device, wherein the dust catch includes:

a channel defined between an inner wall and an outer wall, wherein the outer wall extends around at least part of the outer perimeter, wherein the inner wall is distinct from the abrasion element, wherein the channel includes an inlet, and wherein the inlet extends at least approximately to a surface in contact with an abrasion surface of the abrasion element when the abrasion device is in operation; and a discharger; and operating the abrasion device, wherein at least a portion of dust generated by operating the abrasion device is captured by the dust catch.

2. The method of claim 1, wherein the dust catch further includes a clamp, and wherein attaching the dust catch to the abrasion device includes attaching the clamp to the abrasion device.

3. The method of claim 1, wherein the abrasion device further includes a clamp, and wherein attaching the dust catch to the abrasion device includes attaching the clamp to the dust catch.

4. The method of claim 1, wherein attaching the dust catch to the abrasion device includes coupling the dust catch to the abrasion device using a connector selected from a group consisting of: a screw, a cotter pin, a Velcro attachment, a wire, and a rivet.

5. The method of claim 1, wherein the dust catch further includes a size adjustment, the method further comprising:

modifying the size adjustment to match the size of the abrasion device.

6. The method of claim 5, wherein the abrasion device further includes a wheel, and wherein modifying the size adjustment further comprises:

modifying the size adjustment such that the wheel does not interfere with an exhaust port of the dust catch.

7. The method of claim 1, wherein the abrasion device is a floor sander, and wherein the abrasion surface rotates.

8. The method of claim 1, wherein the outer wall has a first bottom edge, wherein the inner wall has a second bottom edge, and where the inlet extends between the first bottom edge and the second bottom edge.

9. The method of claim 8, wherein the inlet is a substantial percentage of the area extending between the first bottom edge and the second bottom edge.

10. The method of claim 9, wherein the inlet is more than fifty percent of the area extending between the first bottom edge and the second bottom edge.

11. The method of claim 1, wherein the discharger is coupled to the inlet via a first exhaust port and a second exhaust port.

12. A system for capturing dust particulates, the system comprising:

an inlet formed to at least partially encompass an outer perimeter of an abrasion element, wherein the inlet is formed within a skirt, wherein the skirt has an inner wall and an outer wall, wherein the skirt includes a size adjustment element, and wherein the size adjustment element is adjustable to match the size of the skirt to an abrasion device;

a flexible barrier associated with at least one of the inner wall and the outer wall; and at least two exhaust ports expanding from the skirt.

13. The system of claim 12, wherein the inner wall is distinct from the abrasion element, and wherein the inlet extends approximately to a surface in contact with of an abrasion surface of the abrasion element when the abrasion device is in operation.

14. The system of claim 12, wherein the flexible barrier comprises a group of brushes extending below the skirt and formed of a material strong enough to maintain a force within the inlet, and soft enough to avoid damaging a sanded object.

15. The system of claim 12, wherein the system further comprises a latch associated with the skirt, wherein the skirt is formed to fit a rotational floor sander, and wherein the latch is operable to couple the skin to the rotational floor sander.

16. The system of claim 12, wherein the abrasion device is selected from a group consisting of a floor sander and a floor buffer.

17. The system of claim 12, the system further comprising:

a discharger coupled to the inlet.

18. A system for capturing dust particulates, the system comprising:

an abrasion device, wherein the abrasion device includes an abrasion element with an abrasion surface, and wherein the abrasion device includes an outer perimeter;

a dust catch associated with the abrasion device, wherein the dust catch comprises:

an inlet formed to at least partially encompass the outer perimeter;

a skirt including an inner wall and an outer wall, wherein the inner wall is separate from the abrasion element, wherein an inlet extends between a first bottom edge of the inner wall and a second bottom edge of the outer wall, and wherein the inlet is more than fifty percent of the area extending between the first bottom edge and the second bottom edge; and a flexible barrier associated with at least one of the first bottom edge and second bottom edge.

19. The system of claim 18, wherein the dust catch further comprises:

a discharger functionally coupled to the inlet; and an accumulator functionally coupled to the discharger.

* * * * *